United States Patent [19]

Stoerzinger et al.

[11] Patent Number: 4,798,014

[45] Date of Patent: Jan. 17, 1989

[54] POINT-OF-PURCHASE DISPLAY

[75] Inventors: Charles A. Stoerzinger, Medford; James Machlett, Holcombe, both of Wis.

[73] Assignee: Tombstone Pizza Corporation, Medford, Wis.

[21] Appl. No.: 14,294

[22] Filed: Feb. 13, 1987

[51] Int. Cl.[4] ..... G09F 1/00

[52] U.S. Cl. ..... 40/124.1; 40/649

[58] Field of Search ..... 40/16, 10 R, 124.1, 40/594

[56] References Cited

U.S. PATENT DOCUMENTS

| | | | |
|---|---|---|---|
| 2,720,044 | 10/1955 | Montalto | 40/16 |
| 2,850,820 | 9/1958 | Lersch | 40/10 |
| 2,984,031 | 5/1961 | Giesecke | 40/16 |
| 3,077,686 | 2/1963 | Montalto | 40/124.1 |
| 3,706,150 | 12/1972 | Greenberger | 40/124.1 |
| 3,711,977 | 1/1973 | Blankenhorn | 40/124.1 |
| 3,977,109 | 8/1976 | Berry et al. | 40/124.1 |
| 4,161,074 | 7/1979 | DePinna | 40/124.1 |
| 4,167,073 | 9/1979 | Tang | 40/124.1 |
| 4,208,818 | 6/1980 | Butcher | 40/124.1 |
| 4,222,187 | 9/1980 | Huck | 40/16 |
| 4,306,366 | 12/1981 | Taub | 40/16 |
| 4,338,739 | 7/1982 | Greenberger | 40/384 |
| 4,384,418 | 5/1983 | Alley | 40/16 |

*Primary Examiner*—Gene Mancene
*Assistant Examiner*—Wenceslao J. Contreras
*Attorney, Agent, or Firm*—Merchant, Gould, Smith, Edell, Welter & Schmidt

[57] ABSTRACT

A point-of-purchase display is disclosed, which is assembled from a single, folded piece of two-dimensionally rigid material. When assembled, the display includes a vertical display face which is rigidly supported in a plane perpendicular to a vertical support surface. The vertical support surface is suitable for attachment to typical store display shelves. The display face is held in place by a tab which includes a slot, the tab being attached to one edge of the support surface and cooperating with an edge of the display face.

12 Claims, 1 Drawing Sheet

POINT-OF-PURCHASE DISPLAY

BACKGROUND OF THE INVENTION

This invention relates to a point-of-purchase displays suitable for use in connection with typical merchandise display shelving found in grocery stores and the like. These shelves typically have a relatively substantial vertical face on the front edge thereof, on which information relating to produce identification and price is generally displayed. Often, this front edge includes a structure known as a "price rail", which generally comprises a depression into which an elastically deformable, but otherwise two-dimensionally rigid indicia bearing material may be removably inserted.

Merchandisers commonly use the front edges of these display shelves to support point-of-purchase displays. These displays are intended to attract the attention of potential purchasers, to thereby encourage and induce sales of the displayed product. In order to accomplish this objective, the point-of-purchase displays generally include one or more display faces, on which eye-catching and informative printed matter relating to the displayed product is placed.

Because the typical retail establishment arranges its display shelves in long rows, with narrow aisles there between, potential purchasers will generally approach the specific location where a particular product is displayed from a direction, and consequently looking in a direction, parallel to the face of the shelving units. Therefore, it is desirable to use a point-of-purchase display in which the display face is perpendicular to the potential purchaser's line of sight, and thereby also perpendicular to the face of the shelving unit.

Moreover, because such an arrangement generally extends the display face either into the storage area of the shelving unit or into the path of customers, it is essential that the point-of-purchase display support the vertical display face both rigidly and durably. Additionally, it is desirable for the point-of-purchase display to perform this function at a minimum cost and to be able to be assembled from an easily transportable form into the finished state with a minimum of effort and time.

SUMMARY OF THE INVENTION

The present invention provides a point-of-purchase display blocked out from a single pre-cut sheet of two-dimensionally rigid material. When assembled, the display includes a vertical display face which is rigidly and durably supported in a position perpendicular to the mounting surface on which it is placed, typically a store display store shelf. The display can be supported from the vertical front edge of the display shelf, and can be assembled readily and quickly, without depending on the use of any adhesives.

Accordingly to the invention, there is provided a support face, adapted to be secured on a vertical mounting surface, such as a display shelving price rail. Hinged from the top edge thereof by appropriate fold lines is a vertical display face, which extends in a direction perpendicular to the support face.

A tab is hinged from the bottom edge of the support face, the tab including a slot therein. The slot cooperates with an edge of the vertical display face to removably lock the vertical display face into position when the point-of-purchase display is assembled.

The invention also includes means for limiting the downward rotation of the vertical display face with respect to the support face, and means for facilitating the insertion of the edge of the display face into the slot.

In order to afford a more complete understanding of the present invention, reference is now made to the following description of a preferred embodiment. Of course, it should be borne in mind that this embodiment is for purposes of illustration only, and that the interpretation of the present invention should be limited only as required by a fair construction of the appended claims.

BRIEF DESCRIPTION OF THE DRAWINGS

In the attached drawings, in which like parts are correspondingly numbered.

THE PREFERRED EMBODIMENT

Figure 1:
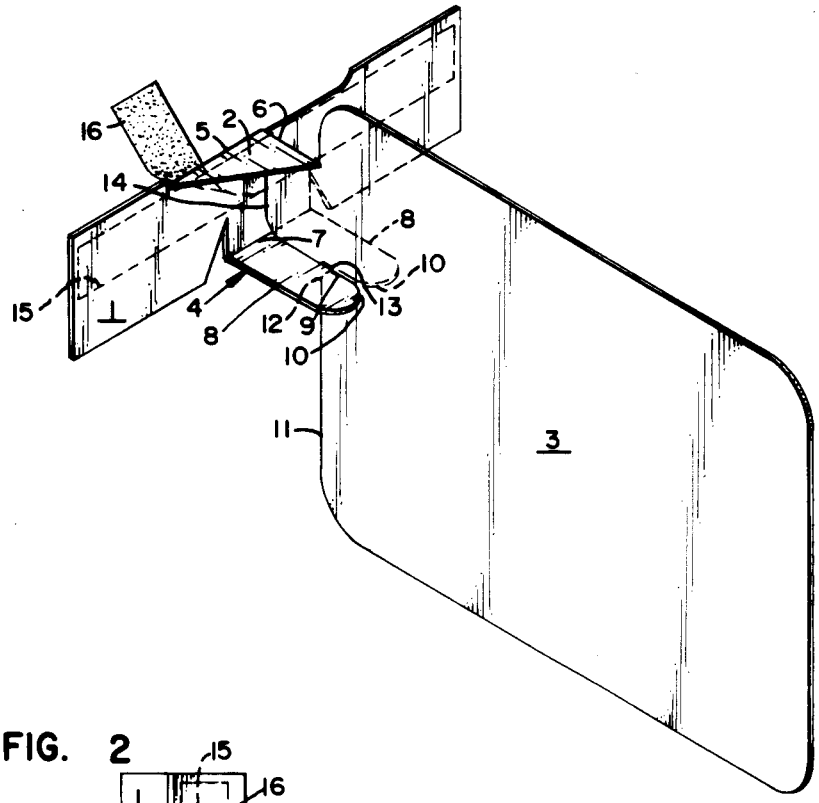
FIG. 1 is an isometric view of a point-of-purchase display showing the present invention in an assembled form.

Referring to the drawings, there is provided a support face 1. Attached thereto by fold line 5 is an intermediate web 2. Intermediate web 2 is in turn attached to display face 3 by fold line 6. Display face 3 may, and typically will, have eye-catching or promotional printed matter on one or both sides thereof.

Attached to the edge of support face 1 opposite to intermediate web 2 is tab 4. Tab 4 is attached to support face 1 by fold line 7. Tab 4 comprises two fingers 8, which define a slot 9 there between. The ends of each finger 8 are supplied with a receding edge 10, which recede into slot 9, and facilitate the assembly of the device in a manner described below.

Display face 3 is provided with a locking edge 11. Locking edge 11 includes a receding edge 12, and a slot 13. the contour of edge 12 recedes into the slot 13, the slot 13 being contacted by tab 4 when the display is assembled. The display face 3 also has along one edge thereof a stop edge 14, which functions in the manner described below.

Figure 2:
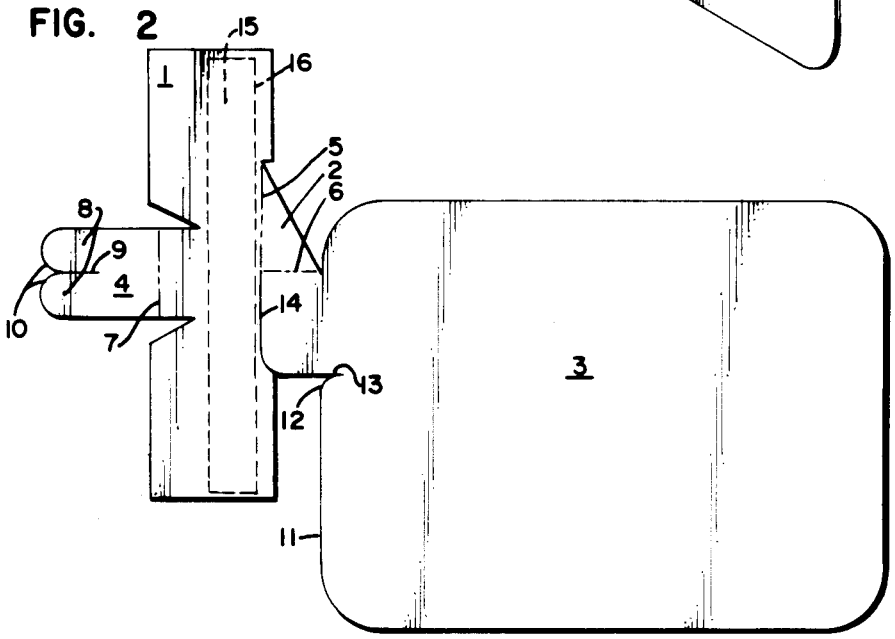
FIG. 2 is a plan view of the point-of-purchase display shown in FIG. 1, prior to its being folded and assembled.

To assemble the point-of-purchase display, the user beings with the device in the configuration illustrated in FIG. 2. First, display face 3 is folded with respect to intermediate web 2 along fold line 6, until the display face is positioned at a 90% angle with respect to the intermediate web. Second, tab 4 is folded with respect to support face 1 along fold line 7 until tab 4 is also at a 90% angle with respect to the support face. Third, intermediate web 2 is folded with respect to support face along fold line 5, until intermediate web 2 is positioned at a 90% angle with respect to support face 1.

At the completion of this third step, several events occur. As can be seen readily in FIG. 1, slot 9 cooperates with slot 13 of the locking edge 13 of display face 3, to firmly position the display face with respect to support face 1. As slot 13 begins to move into slot 9, receding edges 10 on fingers 8, and receding edge 12 on locking edge 11, cooperate to urge tab 4 and display face 3 into the proper relative positions, thereby facilitating assembly of the point-of-purchase display. As intermediate web 2 and display face 3 continue to pivot with respect to support face 1 along fold line 5, locking edge 11 continues to move into slot 9 of tab 4. When locking edge 11, and therefore display face 3, are properly positioned, stop edge 14 of display face 3 contacts support face 1 as shown in FIG. 1. This prevents display face 3 from pivoting further downwards with respect to support face 1.

The assembled display is now ready to be affixed to a suitable support surface. Support face 1 is dimensioned sufficiently to allow it to be placed into a typical display shelf price rail without the use of adhesives. Additionally, the side of support face 1 opposite display face 3 when the point-of-purchase display is assembled is provided with an adhesive strip 15. During shipment, and when the point-of-purchase display is inserted into a price rail, adhesive strip 15 is covered by a removable backing strip 16. In the event that it is desired to secure the point-of-purchase display to a support surface other than a price rail, backing strip 16 is removed, thereby exposing adhesive 15, and the display is affixed to the support surface.

While it is not necessary for the point-of-purchase display of the present invention to be affixed to a support surface of any particular orientation, the present invention lends itself particularly to placement on a support surface which extends in a vertical, or near vertical, plane.

As can now be readily understood, the point of purchase display of the present invention affords several advantages. For example, the display face 3 is held both rigidly and durably in a plane perpendicular to the customer's line of sight. Both sides of the display face are exposed, allowing each to be printed thereon. Moreover, when the display is affixed to the vertical front edge of the shelving unit, neither the support nor the display face obstructs the storage area of the shelf.

Having now fully described the present invention, we claim:

1. A point-of-purchase display assembled from a single, folded piece of two-dimensionally rigid material comprising:

a. a vertical display member having a locking edge;

b. a vertical support member adapted to be secured on a vertical mounting surface; and c. a tab comprising a slot and two fingers, said slot being cut between the two fingers, said slot and fingers being dimensioned such that, when assembled, said locking edge of said display member is positioned in said slot, with one of said fingers on either side of said display member.

2. A point-of-purchase display as set forth in claim 1, wherein said support member has at least two edges, said tab being connected by a fold line to a first edge, and said display card being hinged to a second edge, said first and second edges being opposite edges of said support member.

3. A point-of-purchase display as set forth in claim 2 wherein said display member is hinged to the top edge of said support member.

4. A point-of-purchase display as set forth in claim 3, wherein said display member has a stop edge which contacts said support member when said display member is assembled, to prevent said display member from pivoting further downwards.

5. A point-of-purchase display as set forth in claim 1, wherein the edge of each said finger recedes into said slot, thereby facilitating the insertion of said display member edge into said slot.

6. A point-of-purchase display as set forth in claim 5, wherein the said locking edge of the display member is also provided with slot and a receding contour, said receding contour receding into the slot.

7. A point-of-purchase display as set forth in claim 1, wherein said support member includes both an adhesive-coated portion to affix said support member to a flat mounting surface, and means to secure said support member to a store price rail.

8. A point-of-purchase display as set forth in claim 1, wherein no adhesive is used to maintain the relative positions of said support member and said display member when said display is assembled.

9. A point-of-purchase display assembled from a single, folded piece of two-dimensionally rigid material comprising:

a. a display member formed of a single planar sheet;

b. a support member adapted to be secured on a vertical mounting surface;

c. means for rigidly supporting said display member on said support member when the display member is assembled such that said display member extends in a vertical plane perpendicular to the vertical plane in which said support member lies;

d. means for connecting said display member to said support member whereby said display member is assembled by folding said display member into a plane substantially perpendicular to the plane of said support member and into engagement with said supporting means.

10. A point-of-purchase display in accordance with claim 9 wherein said supporting means comprises a tab receiving said display member in locking engagement.

11. A point-of-purchase display in accordance with claim 10 wherein said connecting means comprises a web member joined to said support member along a first fold line so that said display member may be folded into engagement with said tab and said web member having a second fold line whereby said display member may be folded into said plane perpendicular to the plane of said support member.

12. A point-of-purchase display in accordance with claim 11 wherein said tab member is joined to said support member along a fold line on the opposite side of said support member than said web member whereby said tab may be folded into position to be engaged by said display member.

* * * * *

UNITED STATES PATENT AND TRADEMARK OFFICE

CERTIFICATE OF CORRECTION

PATENT NO. : 4,798,014

DATED : January 17, 1989

INVENTOR(S) : Charles A. Stoerzinger et al

It is certified that error appears in the above-identified patent and that said Letters Patent is hereby corrected as shown below:

Col. 1, line 10
"produce" should be --product--

Col. 2, line 38
"the" (1st) should be --The--

Signed and Sealed this

Fifteenth Day of May, 1990

*Attest:*

HARRY F. MANBECK, JR.

*Attesting Officer*

*Commissioner of Patents and Trademarks*